United States Patent [19]

Lynne et al.

[11] 4,069,892

[45] Jan. 24, 1978

[54] LADDER

[76] Inventors: Tor Lynne, Kjellergaten 37; Egil Martinsen, Elvegt 30, both of 2000 Lillestrom; Arvid Sydtveit, Elgeveien 6, 1830 Ytre Enebakk, all of Norway

[21] Appl. No.: 694,301

[22] Filed: June 9, 1976

[30] Foreign Application Priority Data

Aug. 20, 1975 Norway ..... 752896

[51] Int. Cl.[2] ..... E06C 9/02; E06C 7/08

[52] U.S. Cl. ..... 182/189; 182/93; 182/228

[58] Field of Search ..... 182/100, 189, 228, 93

[56] References Cited

U.S. PATENT DOCUMENTS

| | | | |
|---|---|---|---|
| 144,690 | 11/1873 | Miller | 182/100 |
| 988,719 | 4/1911 | Keyes et al. | 182/93 |
| 1,134,087 | 3/1915 | Mathews | 182/93 |
| 3,512,608 | 5/1970 | Huntley | 182/189 |

FOREIGN PATENT DOCUMENTS

| | | | |
|---|---|---|---|
| 803,948 | 4/1951 | Germany | 182/189 |
| 51,203 | 3/1965 | Germany | 182/189 |

*Primary Examiner*—Reinaldo P. Machado
*Attorney, Agent, or Firm*—Finnegan, Henderson, Farabow & Garrett

[57] ABSTRACT

A ladder for installing against and parallel to a wall or the like, with a central rod from which there extend rungs in opposite directions. The rod has at least one fastening device for fastening the ladder to the wall or the like. At least some of the rungs are equipped at their outer ends with transverse distance pieces, the free ends of which are intended to lie against the wall or the like. The rungs and the distance pieces are made of one piece of rod material, and that the rungs and distance pieces are connected with one another over a part which extends from the outer end of the rung and upward in the installation position of the ladder.

3 Claims, 4 Drawing Figures

LADDER

The present invention relates to an improvement in a ladder of the kind which has a central rod from which stick out rungs in opposite directions. The ladder is intended for various uses, but principally for installing in wells, tanks and the like, as well as for use as a fire- or rescue ladder.

Ladders are known with a simple, central rod from which extend steps in opposite directions. Ladders of this kind are used in hanging position, as a bathing ladder for pleasure craft or as shown in the U.S. Pat. Nos. 2,148,099 and 2,749,188 as emergency ladder in lifts and as ladders up to a service-basket which can be raised and lowered on a car.

In for instance deep wells or other vertical pipe-shaped shafts of different types, it is usual for these to be equipped with firmly attached ladders, when the well has a certain depth. The ladders used in this connection are of the usual type with two side-pieces and rungs between, and the ladders are by means of brackets or the like fastened to the inside of the well of the shaft. The ladders are fastened in several places along their length, and this is a time-consuming job. With respect to concrete wells, there will be sealing problems at the fastening points. It was also usual, previously to use cast steps in such wells, but this is now forbidden.

The present invention aims at providing a ladder which is simple and cheap to produce, at the same time as it is easy to install, especially in wells or vertical shafts. Another advantage of the ladder according to the invention is that it can be easily extended.

This is achieved according to the invention by an improvement in a ladder, to be fastened against and parallel with a wall or the like with a central rod from which protude rungs in opposite directions and where the rod has at least one fastening device for fastening the ladder to the wall or the like.

A preferred embodiment for the invention is characterized in that the rungs and the distance pieces are produced in one piece of rod material, and that the rungs and the distance pieces are connected with each other over a part which extends from the outer end of the rung and upward in the ladder's mounting position. In the same embodiment the upper end of the rod is curved or bent in an angle in the same direction as the distance pieces, and in the free end of the bent part is arranged a curved part with a fastening lug or the like.

The ladder according to the invention is very simple to produce as the rungs, which preferably consist of cylindrical rod material, can be fastened in narrow holes in the central rod and be secured with a tack-weld. The ladder is therefore produced very cheaply. The ladder is also easily installed, inasmuch as in many cases it can just be fastened with a simple bolt at the upper bent away part. In a well the ladder will be steadied sidewise because of the curved surfaces of the well. On account of the special shape of the rungs, there is no question of the ladder twisting, inasmuch as the distance-pieces on the steps are supported against the wall where the ladder is mounted.

The invention will as follows be explained more in detail with respect to the drawing which in FIG. 1 shows a ladder according to the invention, consisting of two parts inasmuch as the parts are drawn slightly apart from each other for the sake of clarity.

Figure 1:
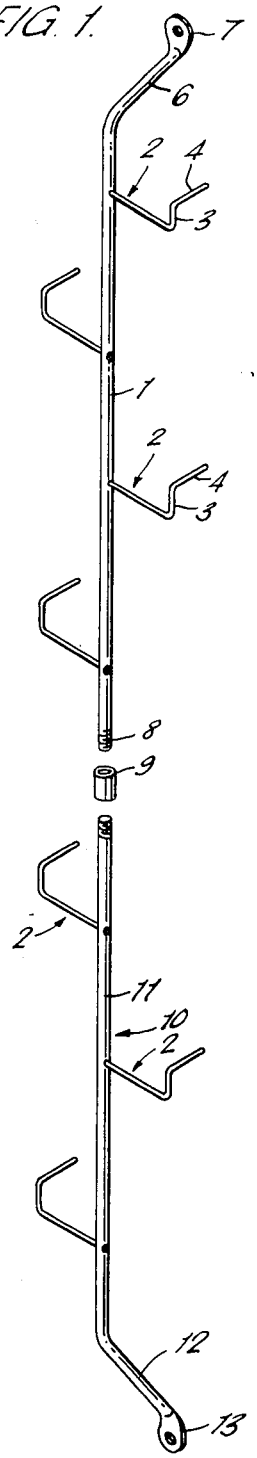
Figure 2:
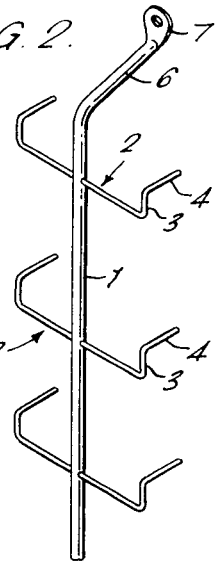
FIG. 2 shows a modified embodiment for the ladder according to the invention.
Figure 3:
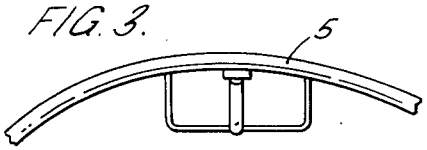
FIG. 3 shows a ladder according to FIGS. 1 or 2, installed inside a well and seen from above.
Figure 4:
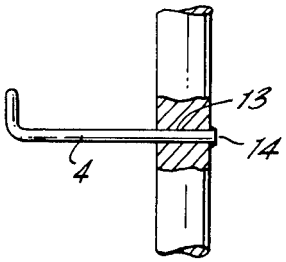
FIG. 4 shows a detail of the attachment of a ladder rung, partly in cross-section.

The ladder according to the invention consists of a rod-shaped central piece 1 to which are fastened upward climbing rungs 2. In FIG. 1 every other rung extends in one direction and the rungs in between, in the opposite direction. In FIG. 2 the rungs are mounted in pairs, so that a step protudes out to each side at the same height. Each step is at the outer end bent upwards somewhat 3, which forms a side support for the foot. This side support continues into an inward turned part 4 when the ladder is mounted, which serves as a distance piece against a wall 5. The simplest form of fastening for the ladder is that the central rod 1 at its one end has an inward bent part 6 which at the end has an eye 7. The central rod 1 is equipped at its lower, free end with a threaded part 8 and can by means of an inward threaded muff 9 be lengthened by an extension 10 with a similarly central rod 11. This rod is like 1 equipped with rung 2 of the same type as rod 1, but reversed in relation to the bent-in part 12 with the fastening lug 15. With this extension the ladder can be fastened both at the top and at the bottom. However, it is not necessary for the extension part 10 to have a bent-in part 12 with fastening lug 15. As is apparent in FIG. 3, the ladder according to the invention will hang firmly without any danger of swinging when only hung in fastening lug 7. The free ends of the distance pieces 4 will namely lie against the inside, curved surface in a shaft, well, chimney or the like. The outermost fastening lug 15 will therefore first and foremost be of use in connection with ladders on a flat vertical wall, for example as a fire-escape ladder or on the surface of a roof. Even though in the drawing, distance pieces 4 are shown on each rung, it is of course only possible to have distance pieces on some of the rungs. The rungs are manufactured of rod material with a cylindrical cross-section. In this way it is very easy to fasten the rungs to the central rod in a simple and reassuring manner from a security point of view. A cylindrical hole 13 is drilled in the central rod of such a dimension that the inner end of a rung 4 barely fits into the hole. The step is led in such a way that a little peg 14 sticks out of the hole on the opposite side of the rung. The rung is fastened by means of this little peg with a tack-weld which does not impair the central rod. In this manner a completely safe fastening of the rungs is achieved. This is very important when it is a question of ladders to be used for example inside high chimneys, deep shafts, tank walls and the like.

As is apparent from the above mentioned, the ladder requires very little material and be produced simply and rationally. It takes little room both for storing and when mounted, and has few joining points so that it is easy to clean, an important factor for instance inside tanks. Inside shafts, wells, tanks and the like the ladder is very easy to install, as it is sufficient to fasten it in the upper end by means of the fastening lug 7.

Having described our invention, we claim:

1. A ladder for installation against and parallel to a wall or the like comprising:

a central rod, a plurality of rungs carried by said central rod at longitudinally spaced intervals therealong and extending in opposite directions therefrom, said rungs lying in a first common plane one with the other, means carried by said central rod for fastening said ladder to the wall or the like, at least a predetermined number of the rungs having transverse distance pieces at their outer ends extending in a direction generally normal to said first common plane for engagement against the wall or the like, said distance pieces having end portions lying in a second common plane generally parallel to said first common plane, each of the rungs of said predetermined number thereof having a portion extending from its outer end to the distance piece carried thereby in a direction generally parallel to said first common plane and said central rod and toward one end of said central rod, said rungs, rung portions, and distance pieces being formed of unitary rod material, said one rod being formed to extend out of said first common plane on the same side thereof as said distance pieces, said fastening means being at least in part carried by the free end of said one rod end.

2. A ladder according to claim 1 wherein the other end of said central rod is formed to extend out of said first common plane on the same side thereof as said distance pieces, said fastening means being at least in part carried by the free end of said outer rod end.

3. A ladder according to claim 1 wherein said central rod has a plurality of openings spaced longitudinally therealong, each rung being receivable at its inner end in an opening in the central rod, and means including a tackweld for securing each said rung and said central rod one to the other when the inner end of each rung is received in the corresponding opening in the central rod.

* * * * *